US005644823A

United States Patent [19]

Montaquila

[11] Patent Number: 5,644,823

[45] Date of Patent: Jul. 8, 1997

[54] EARRING CLIP

[76] Inventor: Robert A. Montaquila, 39 Hamden Rd., Cranston, R.I. 02920

[21] Appl. No.: 602,505

[22] Filed: Feb. 20, 1996

[51] Int. Cl.[6] ..... A44C 7/00; A44B 21/00

[52] U.S. Cl. ..... 24/499; 24/512; 63/12; 63/14.6

[58] Field of Search ..... 24/499, 512, 518; 63/14.5, 14.4, 14.3, 14.6, 14.7, 14.2, 12

[56] References Cited

U.S. PATENT DOCUMENTS

| | | | |
|---|---|---|---|
| 326,135 | 9/1885 | Merritt | 63/12 |
| 687,446 | 11/1901 | Washburn | 63/14.4 |
| 2,013,760 | 9/1935 | McSoley | 24/499 |
| 2,398,995 | 4/1946 | Beck | 63/14.6 |
| 4,003,216 | 1/1977 | Cecere et al. | 63/14.5 |

FOREIGN PATENT DOCUMENTS

| | | | |
|---|---|---|---|
| 0067733 | 1/1915 | Austria | 63/12 |
| 0080620 | 5/1920 | Germany | 63/14.4 |
| 0202616 | 1/1939 | Switzerland | 63/12 |
| 0014786 | 11/1913 | United Kingdom | 63/14.5 |

*Primary Examiner*—Victor N. Sakran
*Attorney, Agent, or Firm*—David S. Resnick; Dike, Bronstein, Roberts & Cushman, LLP

[57] ABSTRACT

A clip for earrings comprising: a movable spring action clip arm and a stationery body, said body having a attachment member at one end thereof and connection means at the other end thereof, one end of said clip arm having means for receiving said body connection means so as to pivotally attach said clip arm to said body for relative spring urged movment towards and away from said clip, said attachment member having a first and second side and an opening extending through said sides, said first side being adapted to receive a decorative element, said second side having a metallic band positioned above said opening and extending from the surface in an arc shape and adapted to receive an earwire.

2 Claims, 2 Drawing Sheets

EARRING CLIP

BACKGROUND OF THE INVENTION

The invention relates generally to jewelry production. More specifically, the present invention relates to an earring backing with an improved earring clip.

A typical earring backing consists of several parts including a wire and a clip. The wire and assembled clip are typically purchased individually from a manufacturer. The purchaser then attaches the clip to a casting, and then attaches the wire to the clip. This, however, necessitates two steps in order to attach the completed backing to the casting. The wire and clip, both being metallic objects, are usually soldered onto the casting. The time and expense associated with soldering these two items to each casting has prompted the present invention.

SUMMARY OF THE INVENTION

It is accordingly the primary object of the present invention to produce an earring clip that permits simplified attachment of the earring wire to the clip.

It is also an object the present invention to produce an earring clip that reduces the number of steps required for attachment of the earring backing to the casting.

Thus, the present invention is directed to a clip for earrings comprising: a movable spring action clip arm and a stationery body, said body having a attachment member at one end thereof and connection means at the other end thereof, one end of said clip arm having means for receiving said body connection means so as to pivotally attach said clip arm to said body for relative spring urged movment towards and away from said clip, said attachment member having a first and second side and an opening extending through said sides, said first side being adapted to receive a decorative element, said second side having a metallic band positioned above said opening and extending from the surface in an arc shape and adapted to receive an earwire.

DETAILED DESCRIPTION OF THE INVENTION

Figure 1:
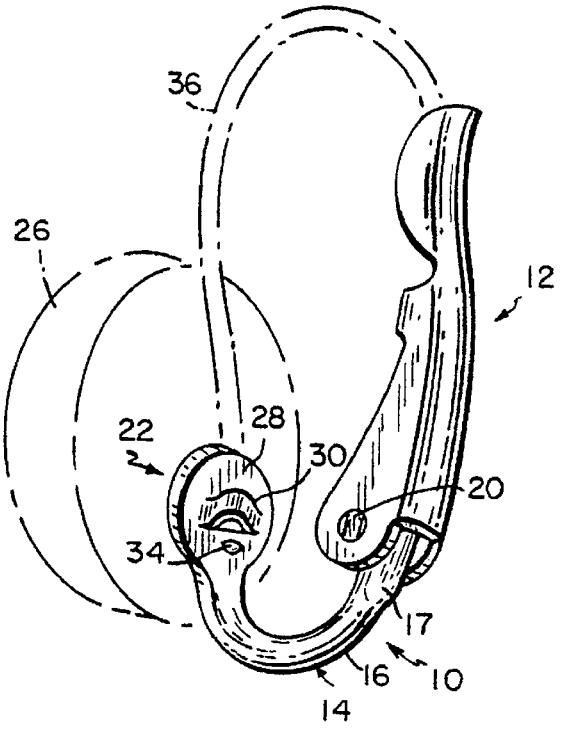
FIG. 1 is a perspective view of an earring clip embodying the present invetion.
Figure 5:
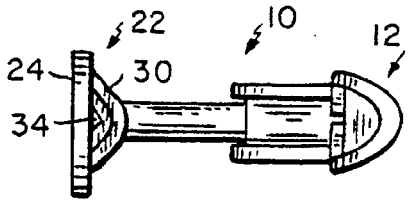
FIG. 5 is a top plan view.
Figure 6:
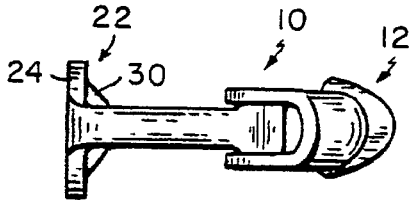
FIG. 6 is a bottom plan view.
Figure 3:
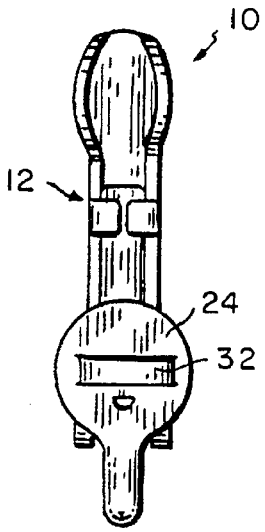
FIG. 3 is an end view of the clip taken from the left of FIG. 2.
Figure 2:
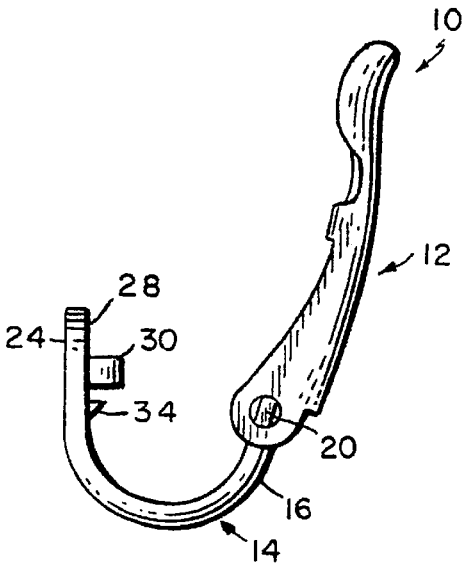
FIG. 2 is a side elevational view thereof.
Figure 4:
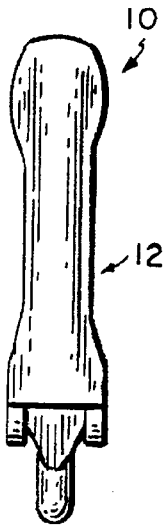
FIG. 4 is an end view of the clip taken from the left of FIG. 2.
Figure 7:
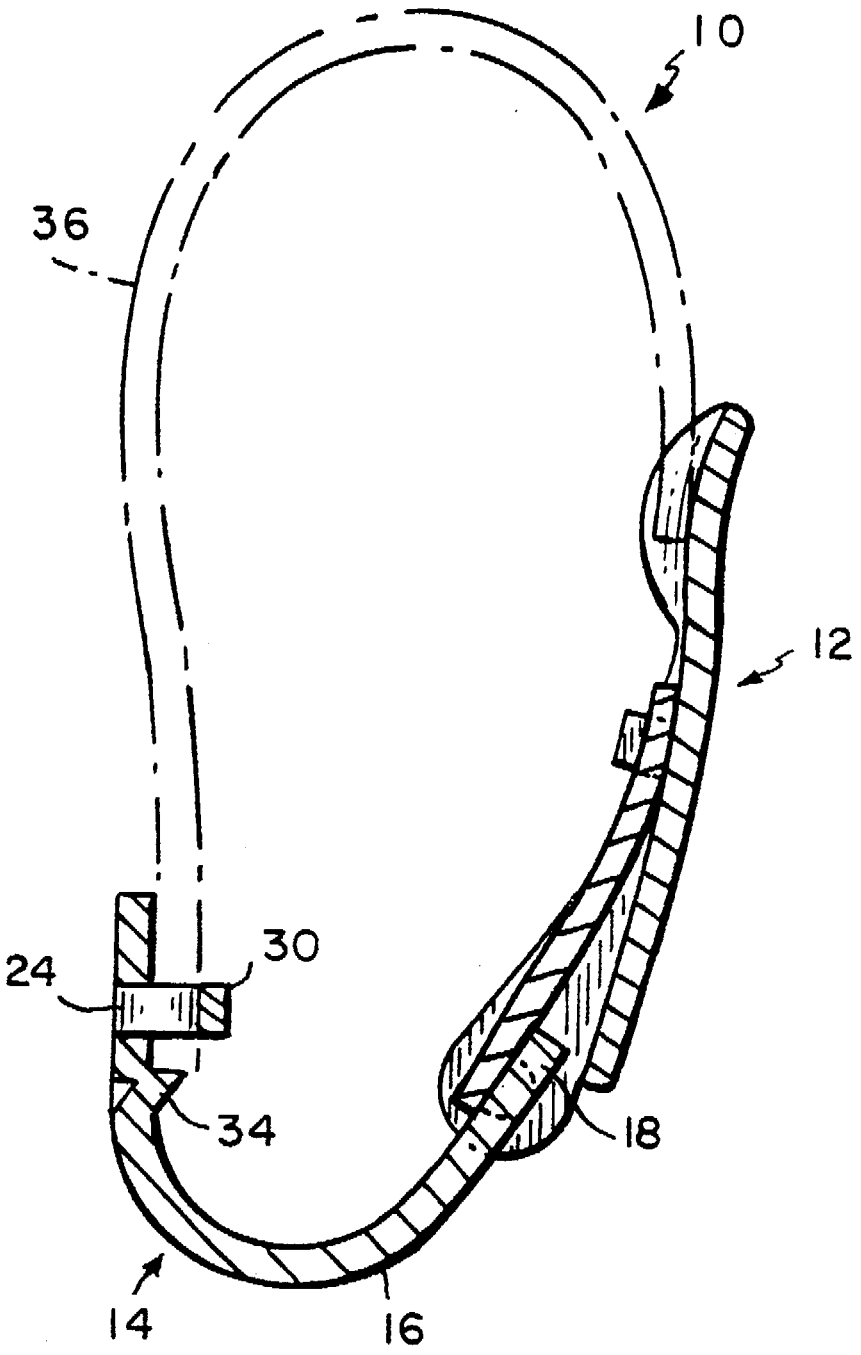
FIG. 7 is a side sectional view similar to FIG. 2 taken along line 5—5 of FIG. 3.

Referring now to the drawings, an earring clip 10 is shown as comprising a movable spring action clip arm 12, a stationery body 14 connected together at lower portions thereof for pivotal movement with respect to each other. The body 14 is of an overall "J" shaped configuration and has a lower curved loop portion 16 and a slightly outwardly flared extension 17 which extends upwardly and terminates in an outer edge 18. The extension 17 includes outwardly extending pintles 20. The other end of the body 14 terminates in a generally circular pad or attachment member 22 having one side 24 adapted to receive a decorative element 26 as best shown the dotted-line representation in FIG. 1 of the drawing. The attachment member 22 has an opening 32 extending through the member. The other side of the attachment member 22, side 28, has a metallic band 30 positioned directly above opening 32 extending from the surface of side 28 in an arc shape and adapted to receive an earwire 36 as best shown by the dotted line representations in FIG. 1 of the drawings. A stop 34 may be positioned adjacent the opening 32 on side 22 allowing only the desired length of wire to contact the attachment member.

The earwire can be affixed to the clip by inserting the wire through the band of the attachment member 22 such that the wire lays over the opening 32 thus allowing the wire to be exposed on the decorative element securing side 24. In this manner, the earwire is positioned adjacent the decorative element and thus the attachment means, e.g., solder or glue, used to attach the decorative element to the attachment member can flow through the opening and simultaneously attach the earwire to the attachment member.

Alternatively, the earwire can be affixed to the clip by inserting the wire through the band of the attachment member and thereafter crimping the band and wire together. Thus, the earring clip of the present invention and earring wire can be sold in an interlocked manner, i.e., as a complete earring backing, allowing the purchaser to merely attach the backing to the casting in one step.

The elements forming the present construction may be formed of any of the conventional jewelry alloy materials, such as copper alloys, shaped, cut and formed by suitable die forming operations. The movable clip arm may be, and preferably is heat-tempered to assure maintenance of the desired separate spring action throughout different positions thereof over the required number of flexures to which the clip structure may be subjected to during normal usage.

Movable spring action clip arms are available commercially. Commercial sources include, for example, Aro-Sac Inc., 1 Warren Ave., North Providence R.I. 02911.

The foregoing description of the invention is merely illustrative thereof and it is understood that variations and modifications can be made without departing from the spirit or scope of the invention as set forth in the following claims.

What is claimed is:

1. A clip for earrings comprising:

a movable spring action clip arm and a stationery body, said body having a attachment member at one end thereof and connection means at the other end thereof, one end of said clip arm having means for receiving said body connection means so as to pivotally attach said clip arm to said body for relative spring urged movement towards and away from said clip, said attachment member having a first and second side and an opening extending through said sides, said first side having a level surface to receive a decorative element, said second side having a metallic band extending from the surface in an arc shape to receive an earwire.

2. The clip of claim 1, further comprising a stop positioned adjacent the opening on said second side.

* * * * *